US005164561A

United States Patent [19]

Schaeffeler et al.

[11] Patent Number: 5,164,561

[45] Date of Patent: Nov. 17, 1992

[54] PUSH BUTTON SWITCH HAVING SEALING BELLOWS

[75] Inventors: Alois Schaeffeler, Spaichingen; Axel Riess, Tuttlingen, both of Fed. Rep. of Germany

[73] Assignee: Marquardt GmbH, Rietheim-Weilheim, Fed. Rep. of Germany

[21] Appl. No.: 866,254

[22] Filed: Apr. 9, 1992

Related U.S. Application Data

[63] Continuation-in-part of Ser. No. 679,203, Apr. 2, 1991, abandoned.

[30] Foreign Application Priority Data

Apr. 12, 1990 [DE] Fed. Rep. of Germany ..... 4011875

[51] Int. Cl.[5] ..... H01H 13/06; H01H 9/04

[52] U.S. Cl. ..... 200/302.2; 200/302.1

[58] Field of Search ..... 200/302.2, 302.1, 345, 200/512; 277/212 R, 212 C, 212 F, 212 FB, 901, 237 A

[56] References Cited

U.S. PATENT DOCUMENTS

| | | | |
|---|---|---|---|
| 2,854,536 | 9/1958 | Beer | 200/302.2 |
| 3,037,099 | 5/1962 | Aandewiel | 200/302.2 |
| 4,128,744 | 12/1978 | Seeger | 200/512 X |
| 4,471,189 | 9/1984 | Bacon et al. | 200/302.2 X |
| 4,652,706 | 3/1987 | Rao et al. | 200/302.2 X |
| 4,673,780 | 6/1987 | Kenway | 200/302.2 |
| 4,766,272 | 8/1988 | Guzzon | 200/302.2 |
| 4,918,270 | 4/1990 | Orrico | 200/345 |
| 5,008,505 | 4/1991 | Takano et al. | 200/302.2 |

*Primary Examiner*—Henry J. Recla
*Assistant Examiner*—David J. Walczak
*Attorney, Agent, or Firm*—Spencer, Frank & Schneider

[57] ABSTRACT

An electrical switch includes a switch casing having an open side; a plunger received in the switch casing and projecting through the open side; a guide defined in the switch casing for guiding the plunger to perform sliding motions in response to an external force exerted thereon; a switching mechanism accommodated in the switch casing for cooperating with the plunger to make or break an electric contact in response to a sliding displacement of the plunger; a lid closing the open side of the switch casing; a sealing arrangement for sealingly securing the lid to the switch casing; and a bell-shaped resilient bellows formed on the lid as an integral part thereof. The bellows projects outwardly from the open side and sealingly surrounds the plunger.

14 Claims, 1 Drawing Sheet

PUSH BUTTON SWITCH HAVING SEALING BELLOWS

This application is a continuation-in-part of application Ser. No. 07/679,203, filed Apr. 2, 1991, now abandoned.

BACKGROUND OF THE INVENTION

The invention relates to an electrical switch that has a casing, an actuation member supported in the casing and depressible manually against a spring force for moving a contact bridge to make or break an electric contact.

It is often required of electrical switches that they can be sealed in a largely liquid-tight, liquid-protected or at least dust-free manner so that no external substances can penetrate the inside of the switch and lead to faults there. However, in order to mount the switch casing with components, it must be accessible from at least one side. Since the switch is provided with fixed and movable components, access is generally made possible from the top or from the bottom of the switch casing.

SUMMARY OF THE INVENTION

The invention is based on the object of providing a largely sealed electrical switch whose easy accessibility is guaranteed during mounting and which can be sealed in a cost-effective manner using simple means.

The electrical switch includes a switch casing having an open side; a plunger received in the switch casing and projecting through the open side; a guide defined in the switch casing for guiding the plunger to perform sliding motions in response to an external force exerted thereon; a switching mechanism accommodated in the switch casing for cooperating with the plunger to make or break an electric contact in response to a sliding displacement of the plunger; a lid closing the open side of the switch casing; a sealing arrangement for sealingly securing the lid to the switch casing; and a bell-shaped resilient bellows formed on the lid as an integral part thereof. The bellows projects outwardly from the open side and sealingly surrounds the plunger.

The switch according to the invention is based on the fundamental idea that initially good preconditions for the tightness of a switch casing are given if the latter consists of a casing which is to a large extent closed off on all sides. Therefore, according to the invention, it is provided that the switch casing is of pot-shaped construction, i.e. only the top of the switch is open for the purpose of mounting the switch with components. The actuation member which can be moved in vertical guide grooves is inserted through this top opening. The actuation member acts with a horizontally displaceable actuation cam on a contact bridge, which is largely vertically arranged, in order to switch-over the switch. Therefore, only the terminal lugs protrude out of this switch casing, which is closed off laterally and towards the bottom. The terminal lugs extend from the casing through corresponding slits which are, however, fully sealed off from the casing.

Furthermore, according to the invention, the casing top which is initially open for mounting purposes is sealed by a lid which fits closely to the switch casing in a positively connecting and/or frictionally connecting manner, the actuation member connecting to said lid in a flexible manner. This top casing termination accordingly serves at the same time as a lid and as a seal, the tappet of the actuation member either protruding through the lid or lying beneath the flexible lid. For this purpose, the top lid is provided in the area of the actuation member with a bell-shaped flexible and elastic bellows which has an opening for the tappet of the actuation member. In order to obtain a good seal here, the actuation tappet may have a circumferential groove in which the top edge of the bell-shaped bellows latches.

The thin-walled bell-shaped bellows can itself be of a construction that produces a snap motion provided with a working point in order to effect a defined switch movement.

In a further embodiment of the invention, an additional seal is achieved in that the lid has a circumferential web which extends into a corresponding groove in the top region of the casing.

It is also advantageous that the casing has upwardly directed pins which engage in corresponding bores of the lid when it is put on and serve to caulk and thus to produce a firm connection.

Therefore, a series of different tasks can be carried out on the switch by the one-piece lid of elastic material.

DESCRIPTION OF THE PREFERRED EMBODIMENT

Figure 1:
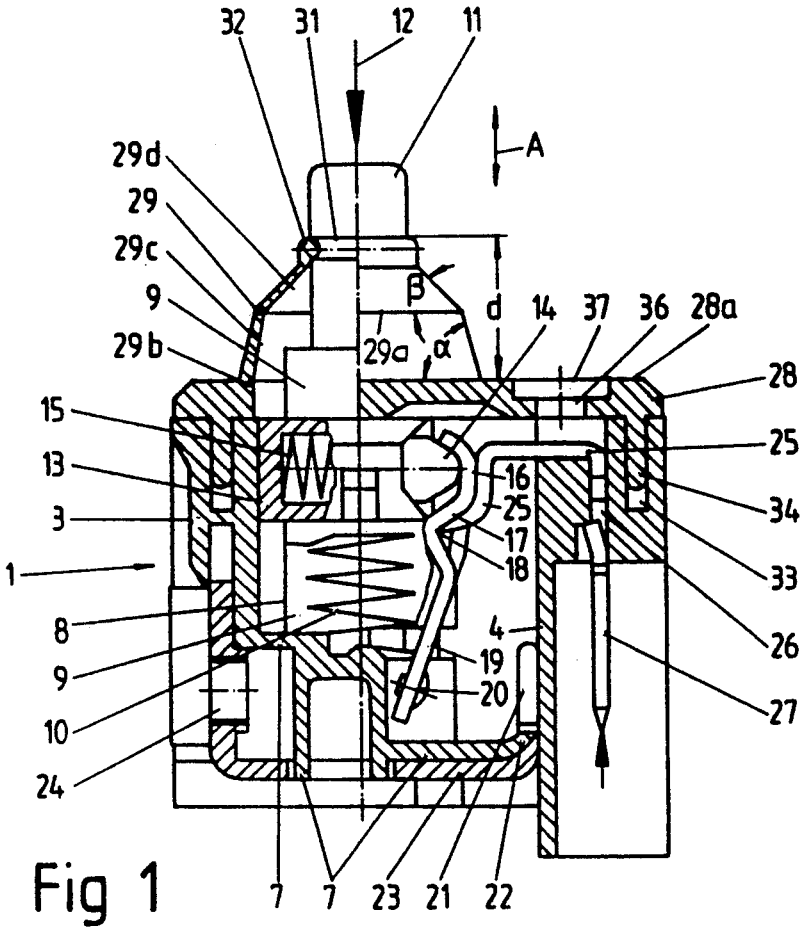
FIG. 1 shows a longitudinal section through the switch casing according to the invention.
Figure 2:
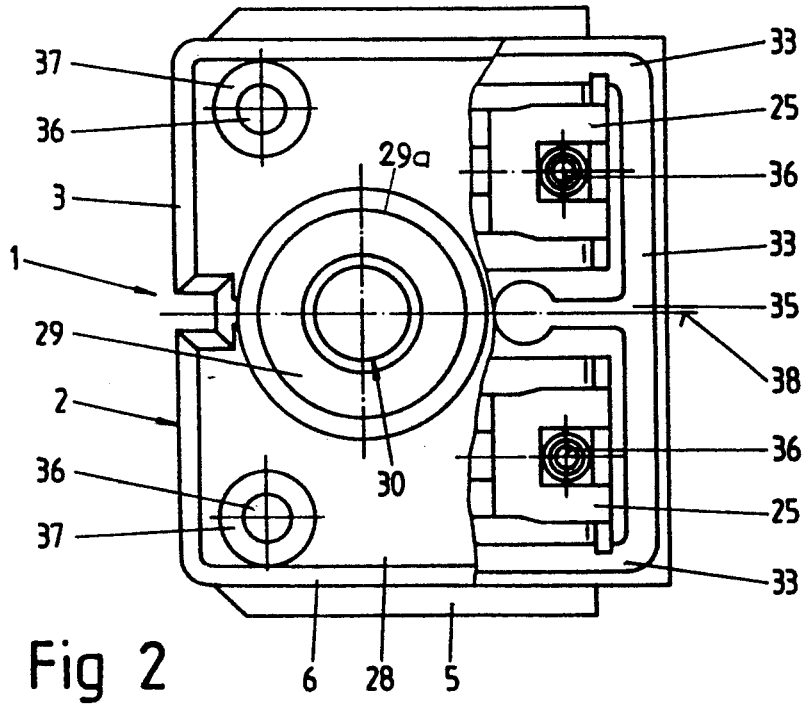
FIG. 2 shows a top view of the illustration in FIG. 1.

The electrical switch 1 shown in FIG. 1 in longitudinal section and in FIG. 2 in a top view is constructed as a double switch with two switch bridges and consists of a switch casing 2 with four closed side walls 3 to 6 and a floor 7 which is closed towards the bottom. In the inside of the switch casing there is an actuation member or plunger 9 which is guided in vertical longitudinal grooves 8 and is constructed as a cylindrical casing, open towards the bottom, for receiving a counter-pressure spring 10. In the top region, the actuation member 9 has an actuation tappet or push button 11 which is loaded with the actuation force 12.

In the top region, the actuation member has two laterally mounted horizontally extending guide casings 13 in which in each case one actuation cam 14 is horizontally guided. A pressure spring 15 pushes the respective actuation cam 14 against the top leg 16 of the respective rocker-shaped contact bridge 17 which is mounted at the rocker pivot point 18. The bottom leg 19 of the contact bridge 17 bears an electrical contact 20 which cooperates with a fixed contact 21. This fixed contact 21 is led out of the inside of the casing through a bottom casing opening 22 and is connected to a connection terminal 24 as a horizontal web 23. The rocker pivot point 18 is constructed as a cutter for the contact bridge and connects to the second electrical connection clip 25 which is led out of the casing in a U-shape via an opening 26. The connection contact 27 serves as a second electrical connection. There are two such arrangements of the switch bridge, the line 38 constituting the plane of symmetry.

The two contact bridges are actuated in that the actuation member 9, 11 is pushed downwards, the two actuation cams 14 sliding suddenly via the radially protruding rocker pivot point 18 of the respective contact bridge 17 from the top leg 16 to the bottom leg 19 and thus causing the two contact bridges 17 to flip over to connect the respective electrical contact 20 to the fixed contact 21.

The switch casing consisting of the side walls 3 to 6 and of the bottom floor 7 is constructed to be upwardly open for the mounting of the components. After the electrical switch is completely assembled, the switch casing is covered from above with a lid 28 which consists of an elastic material at least in the region of the actuation member 9, 11. As seen in FIG. 1, the bellows 29 has a wall thickness which is less than the wall thickness of the lid 28. The lid 28 seals the entire top casing opening, a thin-walled, and thus elastic, bell-shaped bellows 29, being provided, through the top opening 30 of which the actuation tappet 11 of the actuation member 9 can pass. For this purpose, the actuation tappet 11 has a horizontal circumferential groove 31 in which the top edge 32 of the bell-shaped bellows latches.

In order to achieve a further good seal between the casing lid 28 and the switch casing 2, the switch casing has in its top region a horizontal circumferential groove 33 on all sides, into which circumferential web 34 which is formed onto the lid 28 extends in a positively connecting and possible also frictionally connecting manner. The circumferential groove 33 branches inwards in the central area of the casing and forms an additional fixing and support groove 35 into which an associated web area of the lid 28 also engages. In this way, it is also ensured that the central lid area is supported and fixed. The groove 33 can also be formed in this area by a corresponding double-walled embodiment of the casing.

In its upper area, the switch casing also has upwardly pointing pins 36 which can protrude beyond the top edge of the casing and cooperate with corresponding bores 37 in the installed casing lid 28. At the same time, the pins 36 are formed in such a way that after being fitted together with the lid 28 they can be deformed to form a rivet connection, for example by caulking.

The upwardly arched bell-shaped bellows 29 is produced from a material which has thinner walls than the rest of the lid so that this area can also move downwards resiliently when the actuation tappet 11 is actuated. The bellows itself has, in its dome or bell-shaped configuration, an angular break **29*a*** to produce a snap-motion effect at a certain point as the bellows is being deformed, so that a defined switching movement can also be achieved in this way.

The actuation tappet 11 can also be located directly below the upwardly sealed bellows 29 so that no openings have to be provided in this case for the actuation tappet 11. This produces a seal against external influences which is further improved.

In the preferred embodiment illustrated in FIGS. 1 and 2, the unitary lid-and-bellows assembly 28, 29 is made of a thermoplastic elastomer, such as thermoplastic polyurethane, thermoplastically processable synthetic rubber or thermoplastic polyester polyurethane. These materials have a Shore A hardness of 70–90, preferably 70–87. Particular wall thickness relationships between the lid 28 and the bellows 29 provide that the lid 28 is relatively firm and rigid, whereas the bellows—at least an upper portion thereof, as will be described below—is relatively soft and resilient. In particular, the thickness of the wall of the lid 28 measured in a direction parallel to the direction of reciprocation A of the pushbutton 11 is from twice to four times—preferably 2.5 times—the wall thickness of the bellows 29 at the bellows foot **29*b*, that is, at the location where it joins the lid 28**.

Furthermore, the bellows 29 itself is made of a lower portion **29*c* and an upper portion 29*d* which join at the circumferential break line 29*a*. The lower portion 29*c* has a wall thickness which gradually decreases towards the break line 29*a* such that the wall thickness of the lower bellows portion 29*c* at the foot 29*b* is 1.5 times to 3 times—preferably 2 times—thicker than the thickness of the wall of the lower bellows portion 29*c* at the break line 29*a*. The wall thickness of the upper bellows portions 29*d* is uniform and is ⅛ to 1/10 times—preferably 1/5 times—the thickness of the lid 28. Such a relative geometry of the bellows 29 ensures that the lower bellows portion 29*c* is relatively firm and rigid with respect to the upper bellows portion 29*d*. In fact, upon actuation of the pushbutton 11, flexing will occur only in the upper bellows portion 29*d*, simultaneously with a resilient hinging motion about the circumferential break line 29*a***.

Further, the total outline area of the lid 28 is 5 to 10 times—preferably 7.5 times—the circular area covered by the bellows 29. This means that a relatively large area of the lid-and-bellows unit 28, 29 is relatively rigid and thus resistant to mechanical forces.

The lower bellows portion **29*c* conically tapers towards the plunger 11 at an angle $\alpha$ which is approximately between 75° and 80° to the upper face 28*a* of the lid 28. The upper bellows portion 29*d*, in turn, tapers towards the plunger 11 at an angle $\beta$ which is approximately 40° to the upper face 28*a*. thus, at the circumferential break line 29*a* the upper bellows portion 29*d* is inclined at an obtuse angle of approximately 140° to the lower bellows portion 29*c*. Such an angular break ensures that the upper bellows portion 29*d* will readily hinge about the break line 29*a* as the plunger 11 executes its operating motions in the direction A. Further, the break line 29*a* approximately halves the distance d of the total height of the bellows 29 measured from the top to the foot thus providing that, considering the wall thickness relationships of the different parts, a resilient hinging of only the upper bellows part 29*d* is ensured while the lower bellows part 29*c*, together with the lid portion 28** display firmer and less resilient and thus mechanically more protective properties.

It will be understood that the above description of the present invention is susceptible to various modifications, changes and adaptations, and the same are intended to be comprehended within the meaning and range of equivalents of the appended claims.

We claim:

1. An electrical switch, comprising (a) a switch casing having a bottom wall and side walls with upper peripheral edges defining an open side;

(b) a plunger received in said switch casing and projecting through said open side;

(c) guide means defined in said switch casing for guiding said plunger to perform sliding motions in response to an external force exerted thereon;

(d) switching means accommodated in said switch casing for cooperating with said plunger to make or break an electric contact in response to a sliding displacement of said plunger;

(e) a lid extending across and closing said open side of said switch casing; said lid being of a resilient material;

(f) sealing means codirectional with said upper peripheral edge for sealingly securing said lid to said switch casing; and (g) a bell-shaped bellows formed together with the lid as a one-piece member and projecting outwardly from said open side; said bellows having a lower bellows portion including a circumferential foot joining the bellows to said lid; said bellows further having an upper bellows portion joining said lower bellows portion at a circumferential break line about which said upper bellows portion is hingedly movable relative to the lower bellows portion; said upper bellows portion sealingly surrounding said plunger; said lid having a wall thickness being 3 to 10 times greater than a wall thickness of said upper bellows portion.

2. An electrical switch as defined in claim 1, said sealing means comprising a circumferential groove provided in said peripheral edge and a circumferential web formed on said lid; said circumferential web being sealingly received in said circumferential groove.

3. An electrical switch as defined in claim 1, wherein said plunger terminates in a push button projecting outwardly through an aperture defined in said bellows.

4. An electrical switch as defined in claim 3, wherein said push button has a circumferential groove; further wherein said aperture is defined by a circular edge of said bellows; said circular edge being circumferentially sealingly received in said groove.

5. An electrical switch as defined in claim 1, further comprising a plurality of spaced pins projecting from said peripheral edge and means defining holes in said lid; said holes receiving respective said pins.

6. An electrical switch as defined in claim 1, further comprising a spring disposed within said switch casing and biasing said plunger against an external depressing force exerted on said plunger.

7. An electrical switch as defined in claim 1, wherein the wall thickness of said lid is about 2 to 4 times greater than a wall thickness of said lower bellows portion at said foot; the wall thickness of said lower bellows portion being gradually reduced in a direction toward said upper bellows portion and having, at said break line, a thickness approximately equalling the thickness of said upper bellows portion.

8. An electrical switch as defined in claim 7, wherein the wall thickness of said lower bellows portion at said foot is about 1.5 to 3 times greater than at said break line.

9. An electrical switch as defined in claim 8, wherein said lower bellows portion forms an angle of approximately 75°-80° with a lid surface from which the lower bellows portion extends and said upper bellows portion is inclined at an angle of approximately 40° to said lid surface.

10. An electrical switch as defined in claim 1, wherein a total area enclosed by bounding edges of said lid is about 5 to 10 times the area occupied by said bellows on said lid.

11. An electrical switch as defined in claim 1, wherein said bellows has a height measured from a lid surface from which the bellows extends; said break line being approximately at the half point level of said height.

12. An electrical switch as defined in claim 1, wherein said resilient material has a Shore A hardness of between 70 to 90.

13. An electrical switch as defined in claim 1, wherein said resilient material is a thermoplastic elastomer.

14. An electrical switch as defined in claim 13, wherein said thermoplastic elastomer is selected from the group consisting of thermoplastic polyurethane, thermoplastically processed synthetic rubber and thermoplastic polyester polyurethane.

* * * * *